United States Patent [19]

Wright et al.

[11] Patent Number: 4,525,996

[45] Date of Patent: Jul. 2, 1985

[54] MOUNTING COMBUSTION CHAMBERS

[75] Inventors: William B. Wright; Anthony Pidcock, both of Derby, England

[73] Assignee: Rolls-Royce Limited, London, England

[21] Appl. No.: 572,450

[22] Filed: Jan. 20, 1984

[30] Foreign Application Priority Data

Feb. 19, 1983 [GB] United Kingdom ..... 8304682

[51] Int. Cl.[3] ..... F02C 7/20

[52] U.S. Cl. ..... 60/39.31; 60/39.32; 60/748

[58] Field of Search ..... 60/39.32, 39.31, 751, 60/748

[56] References Cited

U.S. PATENT DOCUMENTS

| | | | |
|---|---|---|---|
| 2,650,753 | 9/1953 | Howard et al. | 60/39.32 X |
| 2,709,338 | 5/1955 | Morley et al. | 60/39.32 |
| 2,841,958 | 7/1958 | Stokes et al. | 60/39.32 X |
| 3,394,543 | 7/1968 | Slattery | 60/751 X |
| 3,927,835 | 12/1975 | Gerrard | 60/748 X |
| 4,302,932 | 12/1981 | Kuznetsov et al. | 60/39.32 |
| 4,458,479 | 7/1984 | Reider et al. | 60/39.32 |
| 4,487,015 | 12/1984 | Slattery et al. | 60/39.32 |

FOREIGN PATENT DOCUMENTS 715909 9/1954 United Kingdom .

*Primary Examiner*—Carlton R. Croyle
*Assistant Examiner*—Jeffrey A. Simenauer
*Attorney, Agent, or Firm*—Cushman, Darby & Cushman

[57] ABSTRACT

A front mounting for an annular combustion chamber comprises a flexible ring attached to an engine casing, and radial struts which are attached to the flexible ring and which engage bushes welded to a semi-circular section upstream wall. The arrangement restrains axial movement of the front end of the combustion chamber relative to fuel burners while the radial movement caused by differential thermal displacement to be absorbed by the flexible ring.

1 Claim, 7 Drawing Figures

MOUNTING COMBUSTION CHAMBERS

This invention relates to the mounting of gas turbine engine combustion chambers, in particular annular combustion chambers.

the methods of mounting such chambers can be divided into two types, front mounting or rear mounting. A rear mounting results in relative axial movement between the combustor head and fuel injector over the engine operating range which can compromise engine performance. A front mounting avoids this relative movement and can be achieved by the use of rigid bolting, flexible diaphragms, or sliding pins. The sliding pins provide an arrangement in which there are no locked up stresses due to differential thermal growth, but frettage between the contact surface may occur.

The present invention seeks to provide front mounting for a combustion chamber in which the chamber is located axially and radially, and the mounting allows for radial expansion and contraction, without undue frettage, and the creation of locked-up stresses in the mounting or the chamber.

Accordingly, the present invention provides a front mounting for a gas turbine engine annular combustion chamber, the mounting comprising a flexible ring attachable to an engine structure at a plurality of spaced circumferential locations and a plurality of radial struts, each said strut attached at its outer extremity to the flexible ring between adjacent ones of said circumferential locations, the radially inner part of each said strut engagable with the combustion chamber adjacent the front end thereof, the mounting being such as to restrain axial movement of the combustion chamber relative to the said engine structure, and to allow relative radial movement between the combustion chamber and said structure.

The flexible ring may be located in the plane containing openings in the front end of the combustion chamber arranged to receive fuel burners.

The ends of the radial struts which engage the front end of the combustion chamber may comprise a cylindrical pin arranged to engage a bush attached to the combustion chamber.

Figure 1:
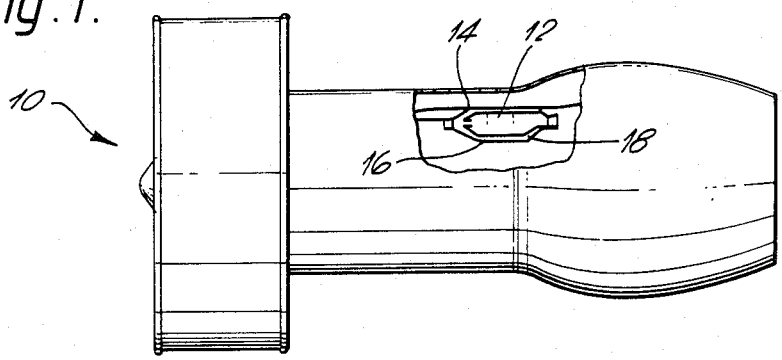
Figure 2:
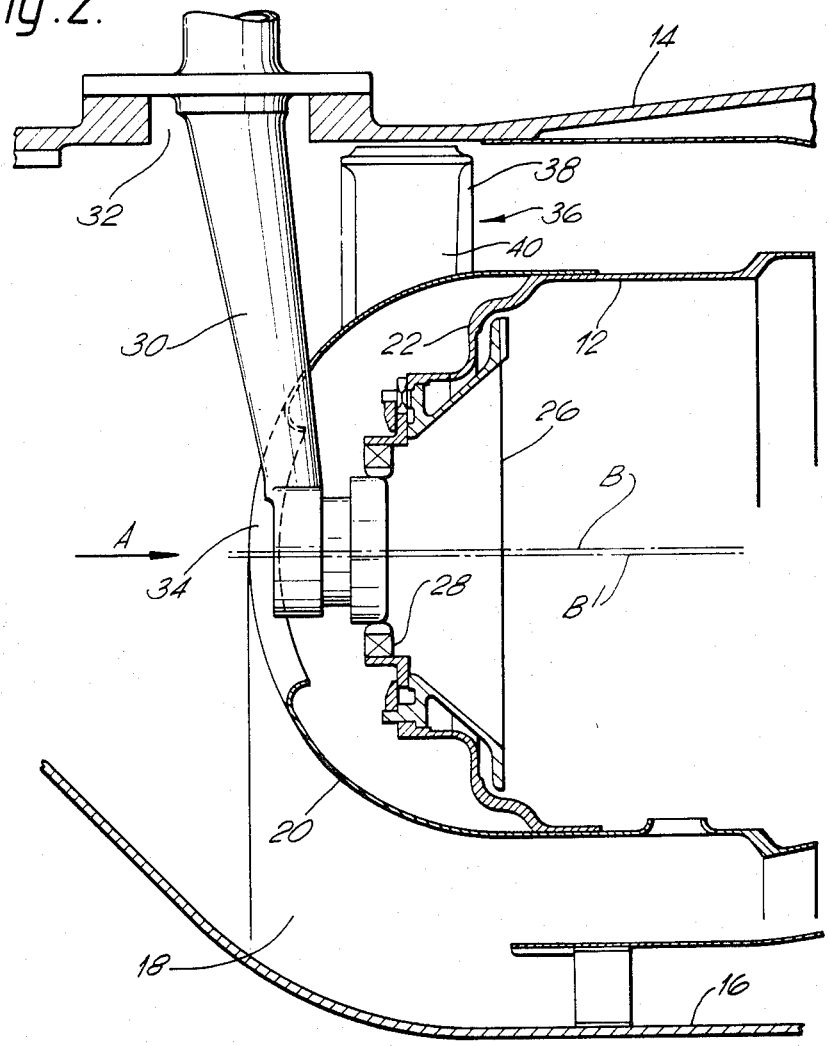
Figure 3:
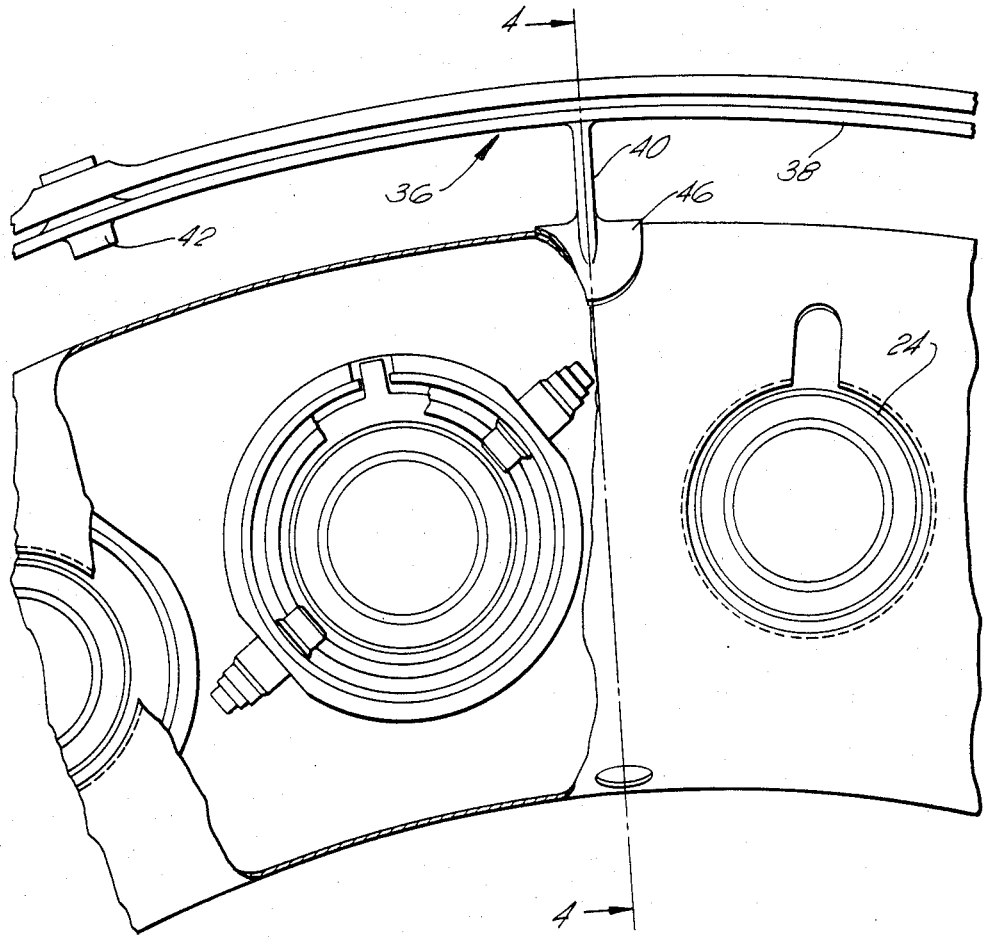
Figure 4:
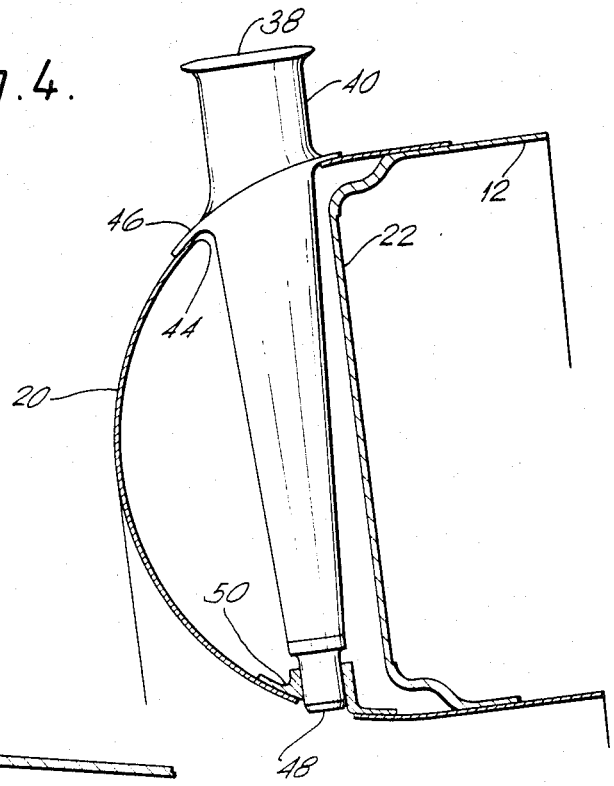
Figure 7:
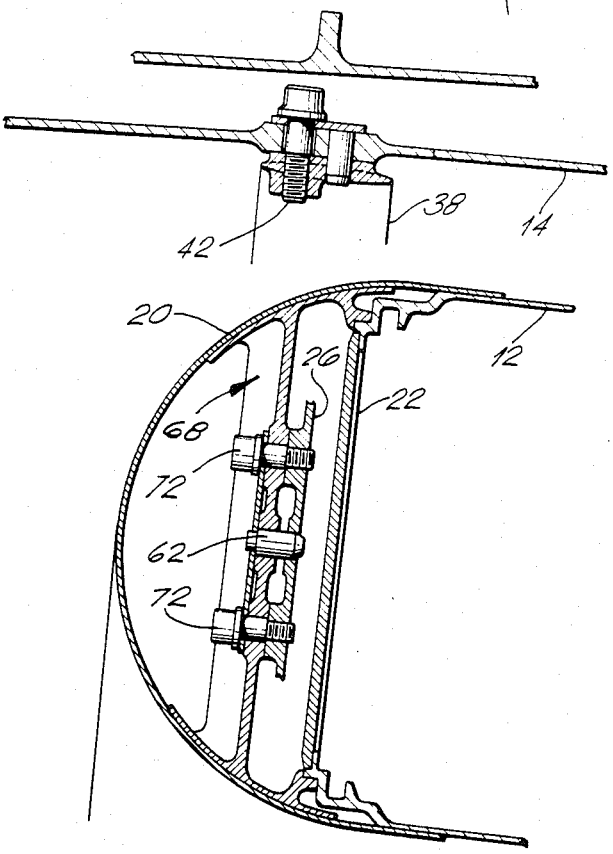
Figure 5:
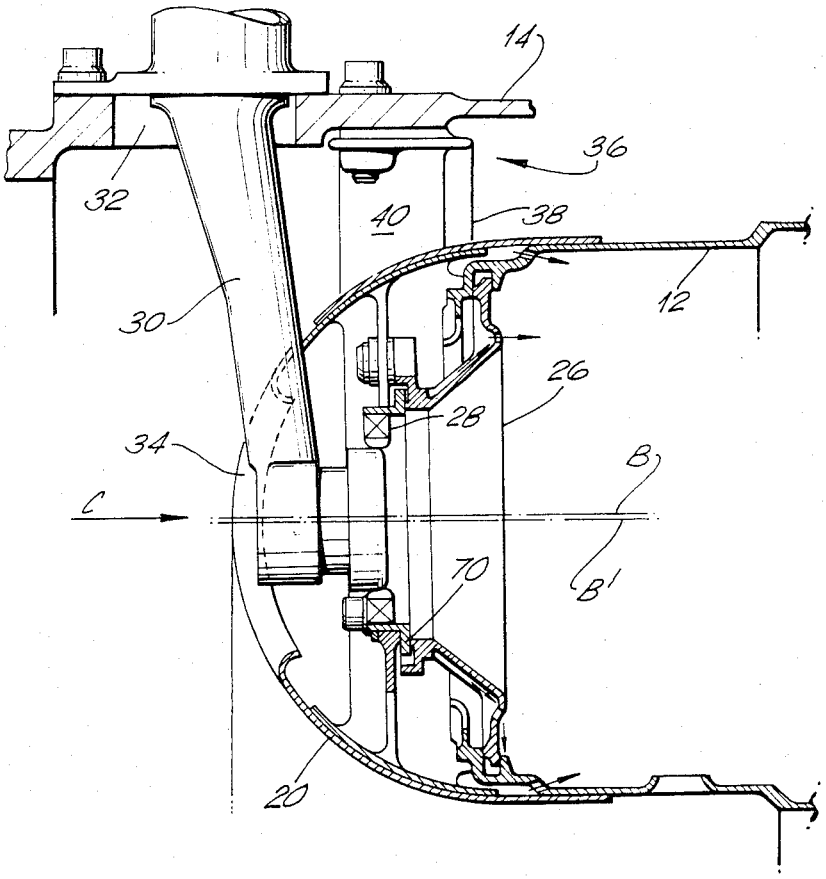
Figure 6:
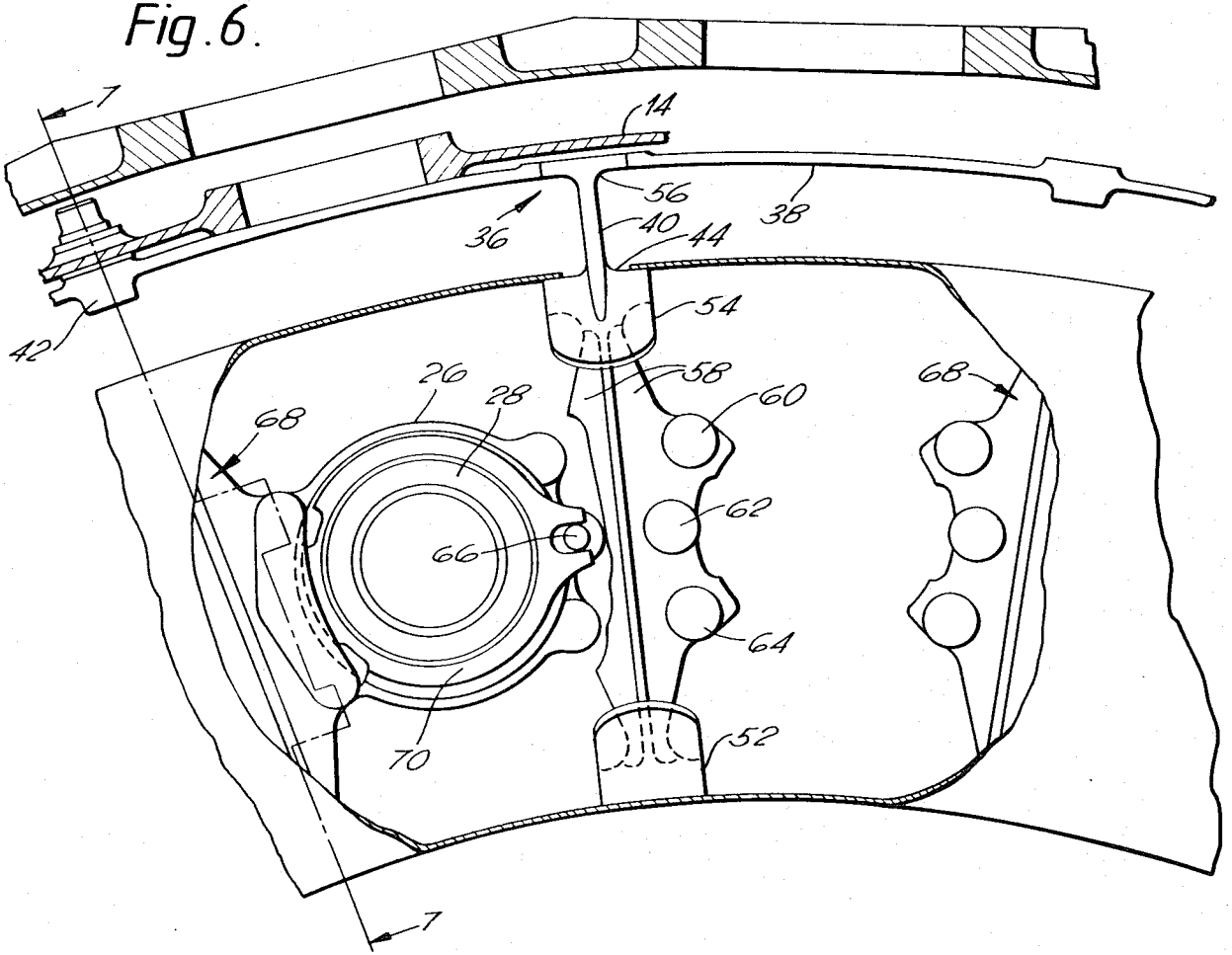

The present invention will now be more particularly described with reference to the accompanying drawings in which, FIG. 1 is a diagrammatic representation of a gas turbine engine having an annular combustion chamber, FIG. 2 is a side elevation to a larger scale showing the annular combustion chamber of FIG. 1 mounted in accordance with the present invention, FIG. 3 is a view on arrow 'A' in FIG. 2, FIG. 4 is a section on line 4—4 in FIG. 3, FIG. 5 is a side elevation of an annular combustion chamber having a modified form of front mounting, FIG. 6 is a view an arrow C in FIG. 5 and FIG. 7 is a section on line 7—7 in FIG. 6.

Referring to the FIGS., a gas turbine engine 10 has an annular combustion chamber 12 mounted inside walls 14, 16 which define an annular air casing 18.

The combustion chamber 12 has a semi-circular section upstream wall 20 and an annular wall 22 which has a number of equi-spaced circular openings 24. A conical heat shield 26, and a ring of swirl vanes 28 are mounted in each opening, the swirl vanes being secured against axial movement but are allowed a restricted radial movement.

A number of fuel burners 30 are attached to the casing 14, each burner passing through a respective opening 32 in the casing and an opening 34 in the wall 20, the head of each burner engaging a respective ring of swirl vanes 28.

The combustion chamber is located within and attached to the casing 14 by a mounting 36 at the front end of the chamber, while the rear or downstream end is mounted with a degree of axial freedom to allow for thermal expansion and contraction.

The mounting 36 comprises a thin, flexible ring 38 and a number of radial struts 40 attached to the ring at circumferentially spaced locations. The ring 38 is secured to the casing 14 by bolts 42 spaced around the periphery of the ring, and the struts 40 are attached to the ring between adjacent ones of the bolts 42.

Each radial strut 40 passes through an opening 44 in the upstream wall 20, and a cover plate 46 is provided on each strut to seal the opening. The radially inner end of each strut is formed as a pin 48 which engages a bush 50 brazed to the radially inner part of the upstream wall.

As a matter of convenience, each strut 40 is located mid-way between a pair of adjacent openings 24 and thus between a pair of adjacent fuel burners 30, with a strut between every other pair of burners. Likewise, the location of the securing bolts 42, which are staggered with respect to the struts by an amount equal to the distance between adjacent openings 24.

The mounting of the annular chamber 12 by the struts 40 and ring 38 to the casing 14 restrains the chamber against axial movement, thereby ensuring that the fuel burner remains correctly positioned in the axial sense, with respect to the swirl vanes 28 and heat shield 26.

Any relative movement between the chamber and the casing in the radial sense, which will occur in operation due to differential thermal expansion and contraction, will be absorbed by the flexing of the ring 38.

The ring of swirl vanes 28 will always remain centred on the head of the fuel burner whatever the radial position of the combustion chamber since the swirl vane ring can move radially in its mounting with respect to the combustion chamber.

The combustion chamber is mounted so that the fuel burners are aligned with the centre-line B of the combustion chamber when the engine 10 is operating at the normal cruise condition. At engine start-up when the engine is cold, the combustion chamber centre-line is at position B′ so that the burners and combustion chamber are slightly mis-aligned at this condition.

Referring to FIGS. 5, 6 and 7, the front mounting 36 has the same basic construction as shown and described with reference to FIGS. 2, 3 and 4, but each strut 40 has a different form providing locations for the swirl vanes 28 and heat shield 26. In addition, the struts are attached to the combustor in a different manner. For the sake of convenience, similar components have been given the same reference numerals as before.

Each strut 40 has two feet 52, 54 and a flange 56. The struts are assembled with the upstream wall 20 prior to the wall being attached to the combustion chamber 12, by passing the flange 56 through the opening 44 and rotating the strut, to bring the feet 52, 54 into contact with their respective parts of the wall 20. The feet are brazed in position and the flange 56 is secured to the ring 38.

The struts each have a pair of circumferentially extending webs 58, the webs each having three bosses 60, 62 and 64, the central one 62, having a pin 66.

As shown in FIGS. 6 and 7, between each strut 40 are located brackets 68 which are similar to the struts 40 as described, but which are not attached to the ring 38.

Each ring of swirl vanes 28 is mounted within a housing 70 which is located by the pins 66 an adjacent one of the struts 40 and brackets 68. The heat shield 26 each have four bosses which are aligned with the corresponding bosses on the struts 40 and brackets 68, and are secured in position by bolts 72.

We claim:

1. A front mounting for a gas turbine engine annular combustion chamber in which the combustion chamber is located within an engine casing and a plurality of fuel burners are attached to the engine casing, each fuel burner locating within a ring of swirl vanes which are radially movable within an opening in an end wall of the combustion chamber, the combustion chamber having a semi-circular upstream wall attached to the end wall, the mounting comprising a flexible ring located between the engine casing and the combustion chamber and attached to the engine casing by a plurality of circumferentially spaced bolts and a plurality of radial struts which pass through openings in the upstream wall, the radially outer ends of each said strut are attached to the flexible ring and the radially inner ends of each said strut are formed as pins which slidably engage bushes attached to the radially inner part of the upstream wall of the annular combustion chamber, and of the bolts securing the flexible ring to the engine casing are located circumferentially between adjacent ones of every other pair of openings in the combustion chamber end wall, and the radial struts are staggered with respect to the securing bolts by an amount equal to the circumferential spacing of said openings.

* * * * *